US009353751B2

(12) United States Patent
Shiibayashi et al.

(10) Patent No.: US 9,353,751 B2
(45) Date of Patent: May 31, 2016

(54) SEALED SCROLL COMPRESSOR FOR HELIUM

(71) Applicant: Hitachi Appliances, Inc., Tokyo (JP)

(72) Inventors: Masao Shiibayashi, Tokyo (JP); Yasushi Izunaga, Tokyo (JP); Takamasa Adachi, Tokyo (JP)

(73) Assignee: Hitachi Appliances, Inc., Tokyo (JP)

( * ) Notice: Subject to any disclaimer, the term of this patent is extended or adjusted under 35 U.S.C. 154(b) by 0 days.

(21) Appl. No.: 14/067,587

(22) Filed: Oct. 30, 2013

(65) Prior Publication Data

US 2014/0119971 A1 May 1, 2014

(30) Foreign Application Priority Data

Oct. 31, 2012 (JP) ..... 2012-240439

(51) Int. Cl.

| | |
|---|---|
| ***F01C 1/02*** | (2006.01) |
| ***F03C 2/00*** | (2006.01) |
| ***F04C 2/00*** | (2006.01) |
| ***F04C 29/04*** | (2006.01) |
| ***F01C 21/00*** | (2006.01) |
| ***F04C 29/00*** | (2006.01) |
| ***F04C 23/00*** | (2006.01) |
| ***F04C 18/02*** | (2006.01) |

(52) U.S. Cl.

CPC ..... *F04C 29/042* (2013.01); *F01C 1/0215* (2013.01); *F01C 1/0261* (2013.01); *F01C 21/001* (2013.01); *F04C 18/0215* (2013.01); *F04C 18/0261* (2013.01); *F04C 23/008* (2013.01); *F04C 29/0007* (2013.01); *F04C 2210/105* (2013.01)

(58) Field of Classification Search

CPC ..... F04C 18/0215; F04C 18/0261; F04C 23/008; F04C 29/0007; F04C 29/042; F04C 2210/105; F01C 1/0215; F01C 1/0261; F01C 1/0253; F01C 21/001

USPC ..... 418/55.1–55.6, 57, 15; 417/366, 410.5

See application file for complete search history.

(56) References Cited

U.S. PATENT DOCUMENTS

| | | | | |
|---|---|---|---|---|
| 4,648,814 | A * | 3/1987 | Shiibayashi | 418/55.6 |
| 4,676,075 | A * | 6/1987 | Shiibayashi | 418/55.6 |
| 6,478,557 | B2 | 11/2002 | Shiibayashi et al. | |
| 2005/0147514 | A1* | 7/2005 | Lifson et al. | 417/310 |
| 2010/0129240 | A1* | 5/2010 | Shiibayashi et al. | 418/55.2 |

FOREIGN PATENT DOCUMENTS

| | | | | |
|---|---|---|---|---|
| JP | 03294683 | A * | 12/1991 | F04C 18/02 |
| JP | 2002-89469 | A | 3/2002 | |
| JP | 2006329067 | A * | 12/2006 | F04C 18/02 |

* cited by examiner

*Primary Examiner* — Theresa Trieu

(74) *Attorney, Agent, or Firm* — Crowell & Moring LLP

(57) ABSTRACT

A suction chamber and the oil injection port are linked, under a certain range of revolution angle, via a suction working chamber formed in the radially outer side by a orbiting scroll outer curve and a fixed scroll inner curve under a certain range of revolution angle. An opening of the oil injection port is provided on a bottom surface between teeth of the fixed scroll so that the suction working chamber formed, in a radially inner side, by a orbiting scroll inner curve and a fixed scroll outer curve and the suction chamber are positioned not to be linked with the oil injection port.

5 Claims, 8 Drawing Sheets

SEALED SCROLL COMPRESSOR FOR HELIUM

BACKGROUND OF THE INVENTION

1. Field of the Invention

The resent invention relates to an overall structure and an optimum operation range of a sealed scroll compressor for helium.

2. Description of the Related Art

A well known example of the related art of a scroll compressor for helium is described in Japanese Patent Application Laid-Open No. 2002-89469 (hereinafter referred to as JP-2002-89469-A). Described in JP-2002-89469-A is that: in order to obtain a sealed scroll compressor for helium capable of stably operating under a range of very small pressure ratio without deteriorating the efficiency, the distal end portion (portion shown in a dashed line) of a scroll wrap for air conditioning is cut so as to obtain a tooth shape of a scroll wrap having a smooth arc 66 with a radius of R1 connecting point A and point C. The point A is an initial point of an involute curve 65. Curve 68 is also an involute curve. Point D and point C is connected with an arc with a radius of R3. In this configuration, a fixed scroll and a orbiting scroll have a scroll tooth shape with a set volume ratio Vr of 1.8 to 2.3 in the scroll wrap portion (See Abstract).

In JP-2002-89469-A, an exemplary structure of a sealed scroll compressor for helium including an oil injection mechanism part, for cooling a helium working gas, connected to an oil injection port provided on an end plate of a fixed scroll via an oil injection tube penetrating a sealed container, is described. It is also described that the set volume ratio Vr (Vth/Vd, i.e., a ratio of a stroke volume Vth which is a maximum suction volume to a volume Vd which is a volume of an innermost chamber) of a compression chamber formed by a fixed scroll side and a orbiting scroll side is around 2.1 and that the operation pressure is from a standard condition to the maximum suction pressure condition which is about 0.6 MPaG to 1.0 MPaG or smaller.

In such related art, obtainable flow rate of helium gas may be limited. And under an operation condition in which the operation pressure ratio Pd/Ps (ratio of a discharge pressure Pd to a suction pressure Ps) may be as small as from 1.5 to 1.7, due to a notable decrease in a flow rate of an injection oil for cooling, sealability inside the compression chamber may be deteriorated which may result in a rise in a compressor input and a notable reduction in volumetric efficiency.

SUMMARY OF THE INVENTION

In order to solve the problem, such configuration as described in the claim is employed. The present invention includes a plurality of means for solving the problem. One such example is a sealed scroll compressor for helium in which: a working gas is a helium gas; a scroll compression mechanism part and a motor part are contained in a sealed container; a compression chamber is configured by a fixed scroll in which a scroll-shaped wrap is vertically provided on a fixed side plate and a orbiting scroll engaging wraps with each other in the scroll compression mechanism part; the orbiting scroll is engaged with an eccentric mechanism connected to a rotating shaft, and revolves relative to the fixed scroll without rotating on the axis of the orbiting scroll; the fixed scroll is provided with a discharge port with an opening to the center portion of the fixed scroll, and a suction port with an opening to the outer periphery of the fixed scroll; the helium gas which is suctioned from the suction port is compressed as the helium gas advances in the compression chamber toward the center portion thereof, and then discharged from the discharge port; an oil injection tube for cooling the helium gas is provided so as to penetrate the sealed container and be connected to the oil injection port provided on the fixed side plate; a suction chamber located at the terminal end portions of both the scroll wraps links with the oil injection port, under a certain range of revolution angle, via a suction working chamber formed in a radially outer side by a orbiting scroll outer curve and a fixed scroll inner curve; and an opening of the oil injection port is provided on a bottom surface between teeth of the fixed scroll so that the suction working chamber formed, in a radially inner side, by a orbiting scroll inner curve and a fixed scroll outer curve, and the suction chamber are positioned not to be linked with the oil injection port.

Further, the range of the revolution angle in which the suction chamber links with the oil injection port via the suction working chamber formed, in the radially outer side, by the orbiting scroll outer curve and the fixed scroll inner curve is preferably about 180 degrees. The opening of the oil injection port is preferably circular-shaped and a hole diameter of the opening is preferably determined to be larger than the thickness of the wrap of the orbiting scroll.

Further, it is preferable that the center of the opening of the oil injection port is located in a position which is about $2\pi/3$ rad, by a scroll wrap winding angle, inside in the circumferential direction from the wrap spiral end portion of the fixed scroll inner curve ($\pi$ is the ratio of the circumference of a circle to its diameter).

Further, the suction pressure is preferably determined to be in a range from 1.5 MPaG to 1.8 MPaG, and the discharge pressure is preferably determined to be in a range from 2.8 MPaG to 3.1 MPaG. Further, the ratio Ps/Vr which is a ratio of a suction pressure Ps to a set volume ratio Vr of a pressure chamber formed by the fixed scroll side and the orbiting scroll side is preferably in the range from 0.7 MPaG to 1.2 MPaG.

By employing the configuration of the embodiment according to the present invention, such effect as described below can be obtained with the sealed scroll compressor for helium.

1. By employing the oil injection port structure of the embodiment according to the present invention, gas cooling is facilitated by oil injection to a radially outer side, that is, a suction working chamber side, which is susceptible to heating effect from the periphery during the suction process. Thereby, a high volumetric efficiency and an effect of reducing compression power owning to the decrease in internal leakage between the compression chambers even under a required condition of low operation pressure ratio Pd/Ps of around 1.6.

2. Since the high suction pressure condition is set, a high gas flow rate can be obtained and a compressor can be small-sized, which benefits in manufacturing cost. Also, since a controlling range of the gas flow rate can be broadened, the effect on energy saving greatly improves.

3. Since the relation between the set volume ratio and the suction pressure is optimally determined, the He coefficient of performance drastically improves compared to a conventional apparatus under the required condition of a low operation pressure ratio Pd/Ps of around 1.6, thus producing drastically high effect of energy saving.

4. When the compression power decreases, a load applied to the sliding portion of bearings decreases, thereby improving reliability of the overall compressor. Also by decreasing the load on the bearing, the effect of extending the life of a rolling bearing 40 may be obtained.

Problems, structures, and effects not mentioned above will be apparent by the following descriptions on embodiments.

DESCRIPTION OF THE PREFERRED EMBODIMENTS

An embodiment of the present invention will be described below referring to FIGS. 1 to 11.

First Embodiment

Figure 1:
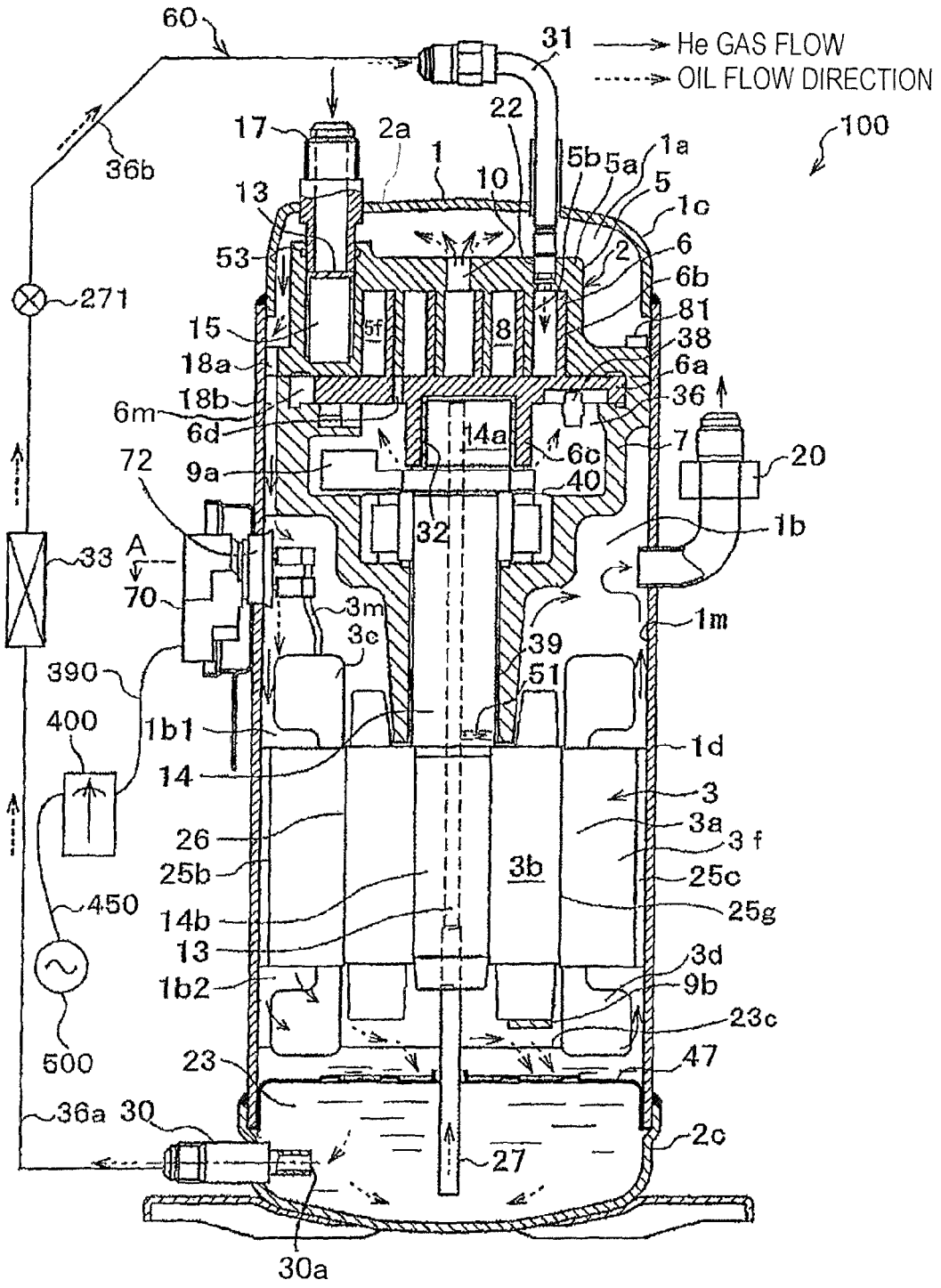
FIG. 1 is a longitudinal cross sectional view illustrating an embodiment of overall structure of an upright type sealed scroll compressor for helium of the embodiment.
Figure 2:
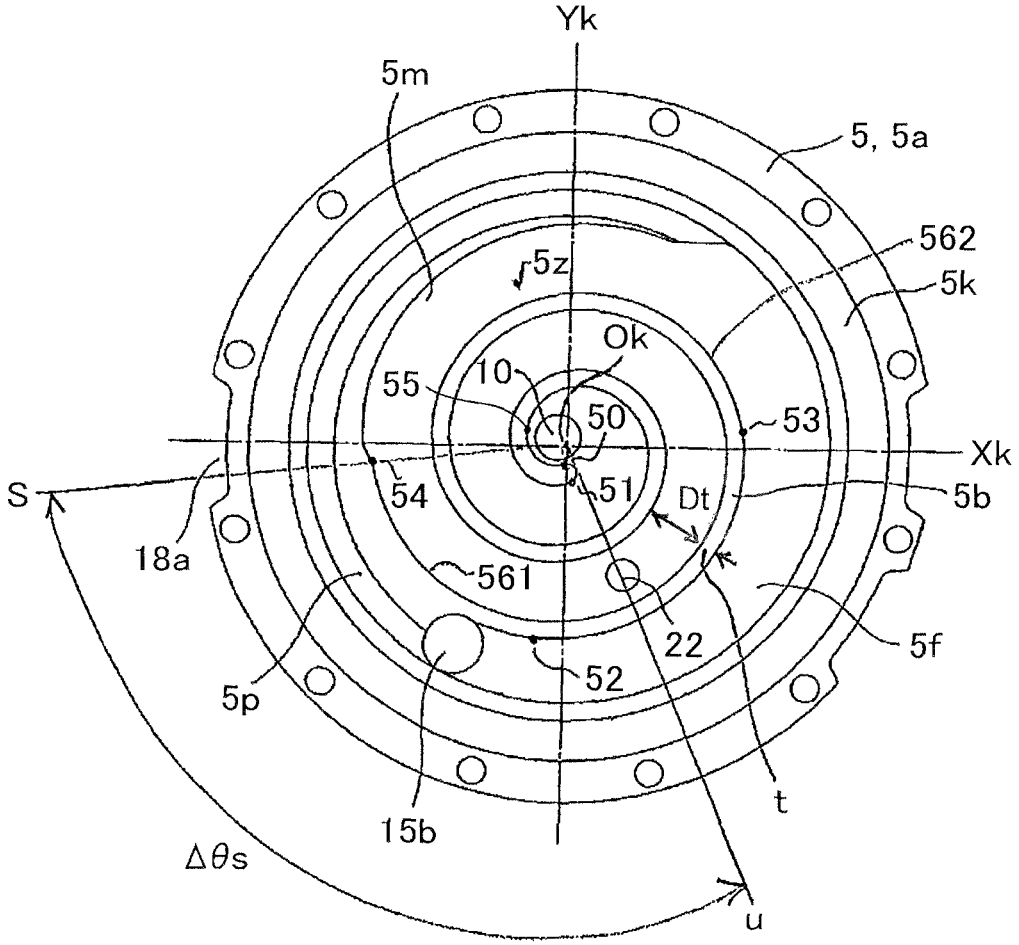
FIG. 2 is a plan view of a fixed scroll.
Figure 3:
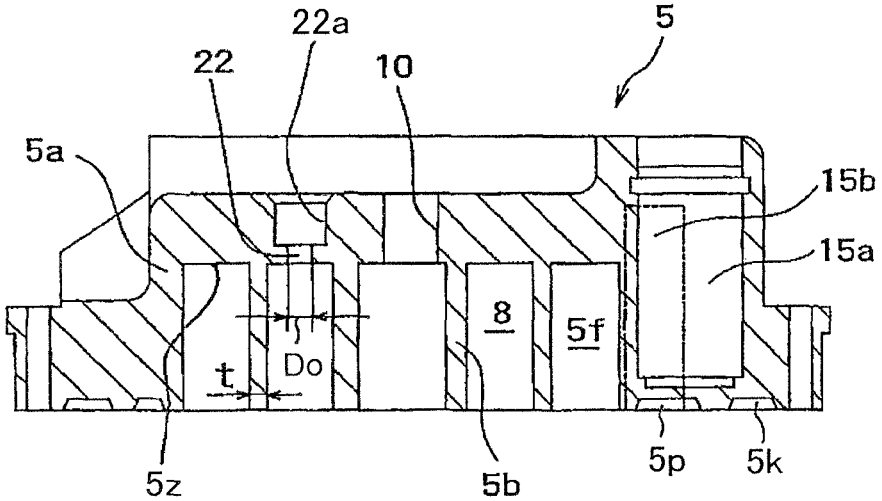
FIG. 3 is a longitudinal cross sectional view of a fixed scroll.
Figure 4:
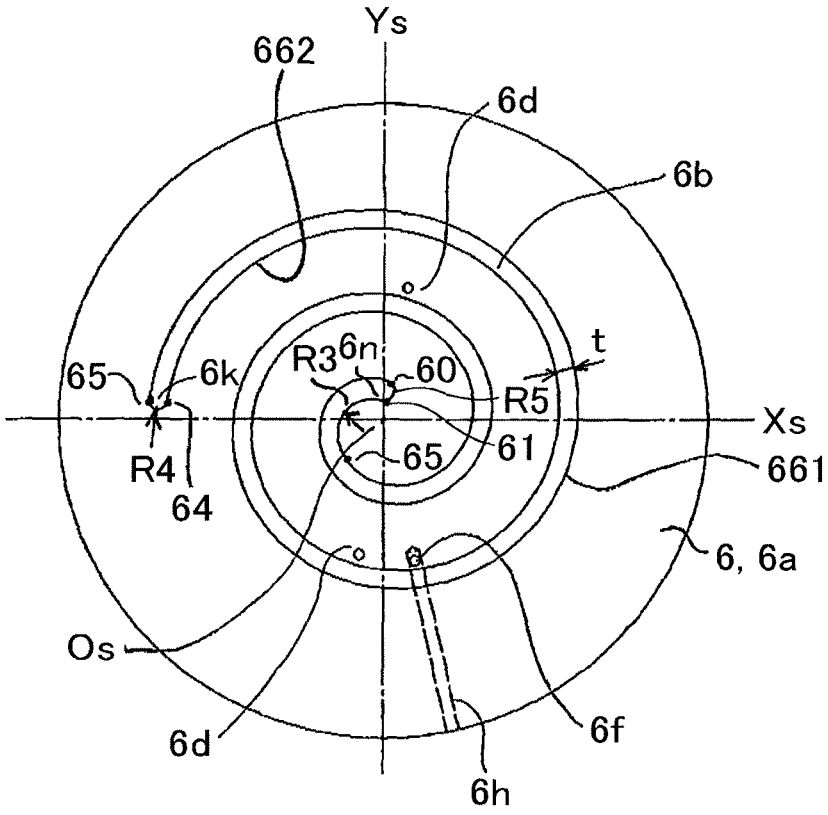
FIG. 4 is a plan view of a orbiting scroll.
Figure 5:
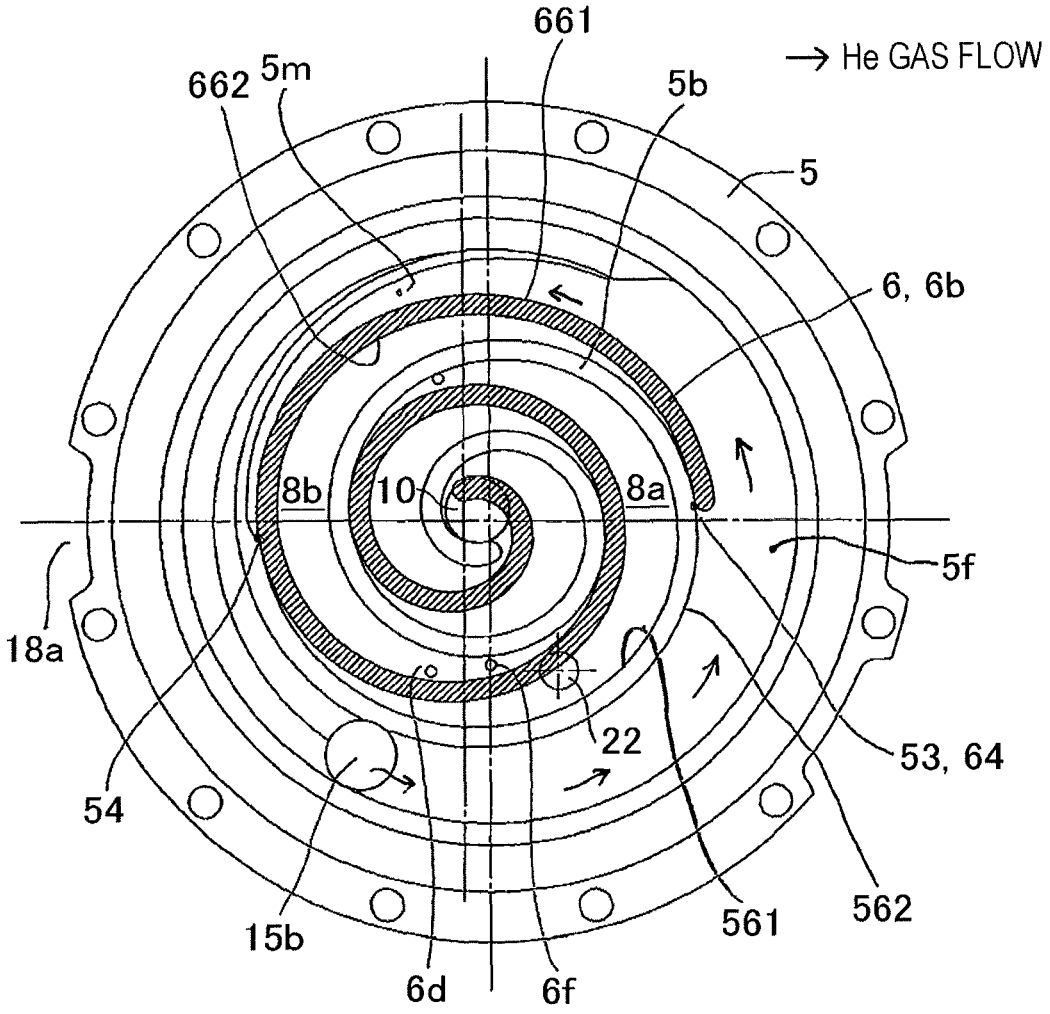
FIG. 5 illustrates a state in which a fixed scroll and a orbiting scroll are engaged with each other after each suction process of an outer curve chamber and an inner curve chamber is completed.
Figure 6:
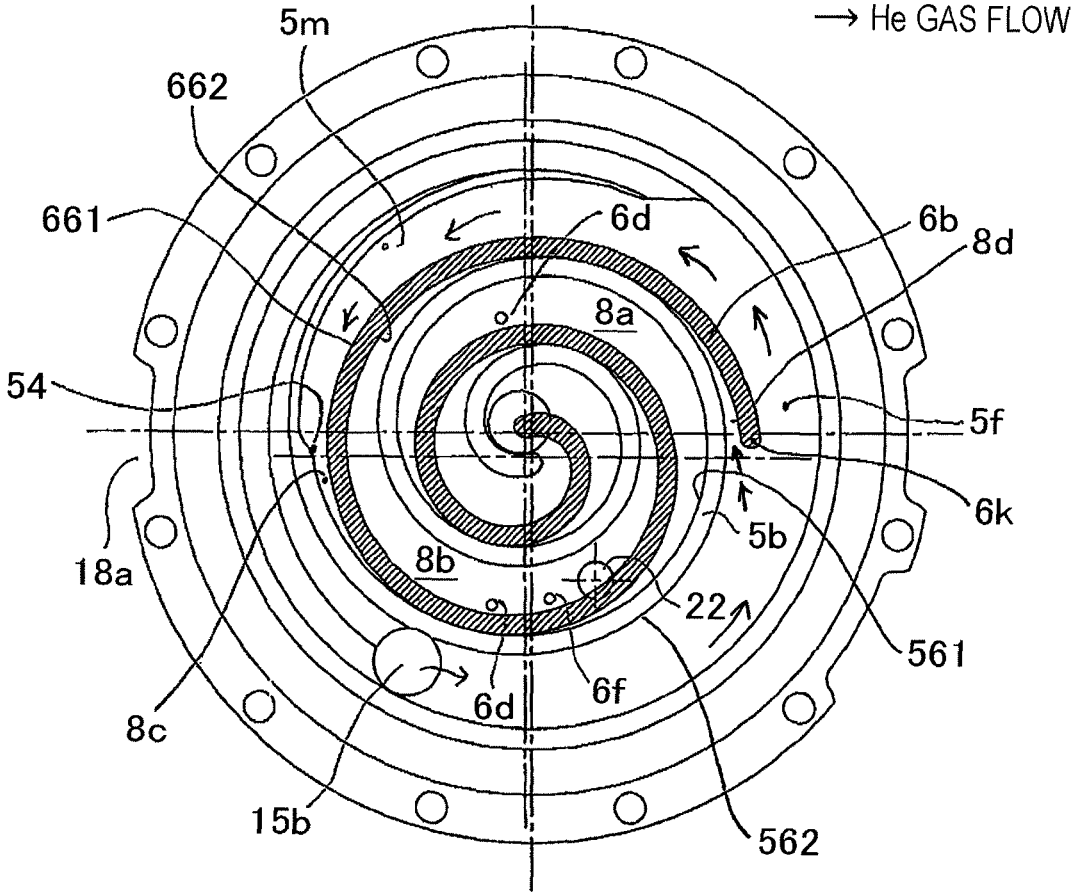
FIG. 6 is an example in which the fixed scroll and the orbiting scroll are engaged with each other after advancing the revolution angle for about a half the π from the state in FIG. 5.
Figure 7:
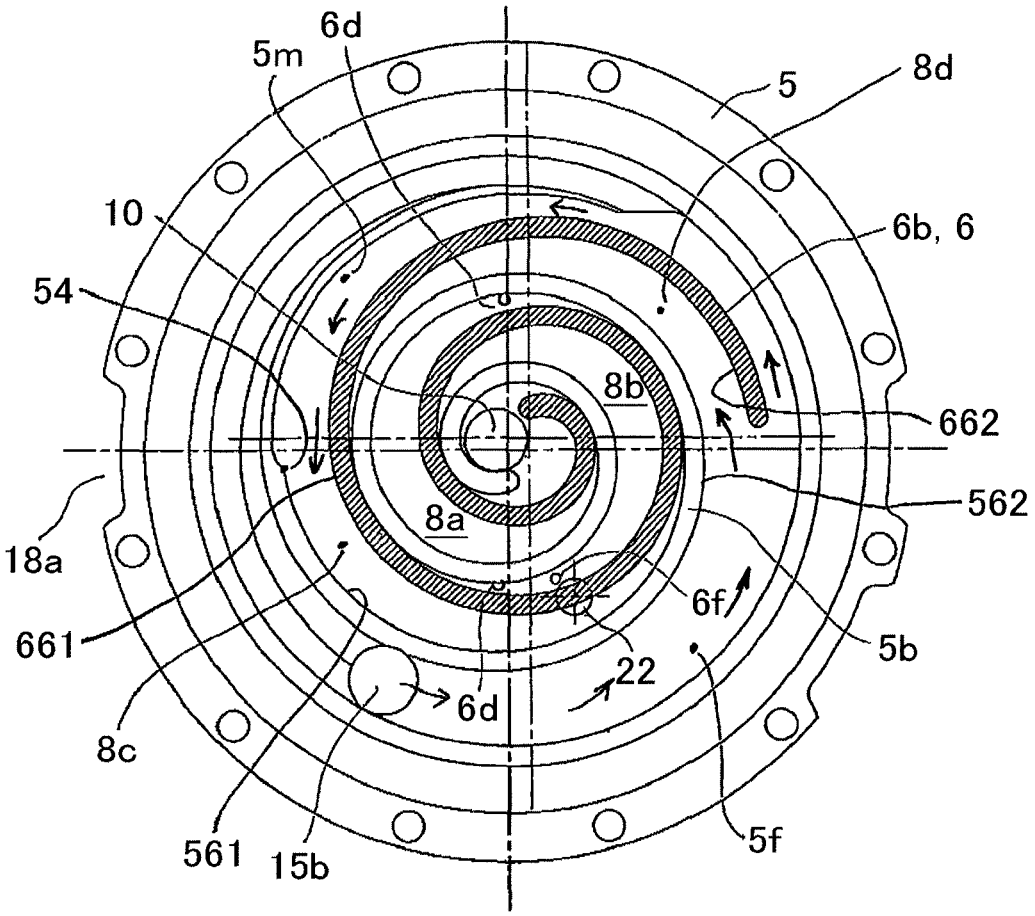
FIG. 7 is an example in which the fixed scroll and the orbiting scroll are engaged with each other after further advancing the revolution angle for about half the π from the state in FIG. 6.
Figure 8:
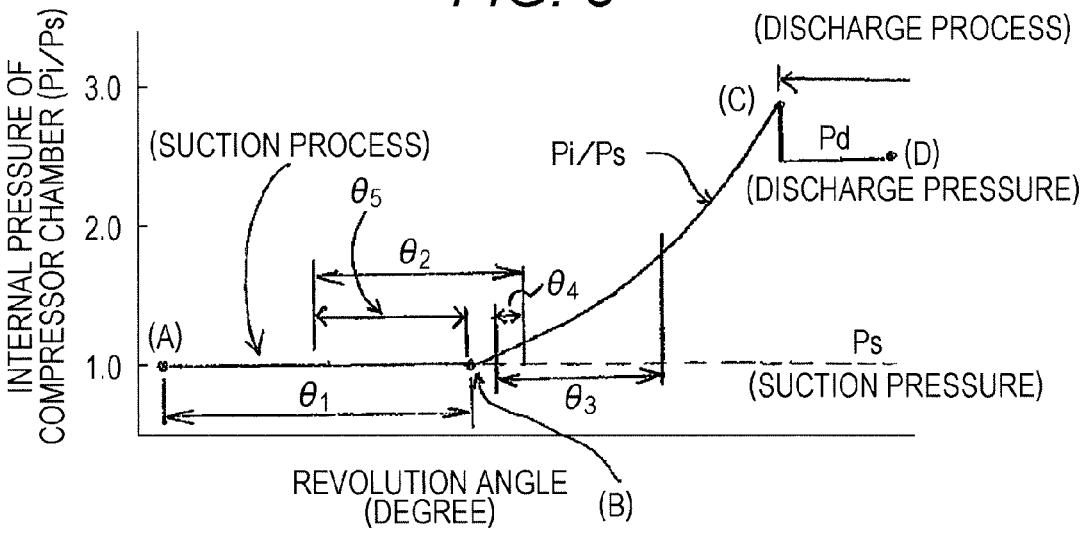
FIG. 8 illustrates a change in an internal pressure of a compressor with relation to the revolution angle (compression line)

FIG. 1 is a longitudinal cross sectional view illustrating one embodiment of an oil injecting sealed type sealed scroll compressor for helium having an upright structure of the embodiment according to the present invention. FIG. 2 is a plan view of a fixed scroll 5 and FIG. 3 is a longitudinal cross sectional view of the fixed scroll 5. FIG. 4 is a plan view of a orbiting scroll 6. FIGS. 5 to 7 are cross sectional view illustrating the fixed scroll 5 and the orbiting scroll 6 of the embodiment according to the present invention. FIG. 8 is a compression line illustrating pressure changes during compression in the compression chamber (a orbiting outer compression chamber (outer curve chamber) 8*a* and a orbiting inner compression chamber (inner curve chamber) 8*b*) according to a revolution angle.

The flow of a helium working gas and the flow of an injected cooling oil will be described using FIG. 1. An oil injection tube 31 penetrates an upper cover 2*a* of a sealed container 1 to be connected to an oil injection port 22 provided on an end plate portion 5*a* of a fixed scroll 5. An opening of the oil injection port 22 faces the tooth-tip-end surface of a wrap 6*b* of a orbiting scroll 6 (wrap of rotating side).

In the upper portion inside the sealed container 1, that is, a suction tube 17 side, a scroll compression mechanism part is contained, and in the lower portion, a motor part 3 is contained. Further, the inside of the sealed container 1 is parted by a frame 7 into a discharge chamber 1*a* and a motor chamber 1*b*.

As illustrated in FIG. 5 and FIG. 6, the fixed scroll 5 and the orbiting scroll 6 engage with each other to form a compression chamber 8 (8*a*, 8*b*) in the scroll compression mechanism part. The orbiting scroll 6 is constituted with a disk-shaped end plate 6*a* (plate of the rotating side), a wrap 6*b* (wrap of rotating side) vertically provided on the end plate 6*a* and formed in a same shape as the wrap of the fixed scroll, and a boss 6*c* formed on the end plate surface on which the wrap is not provided. As illustrated in FIG. 7, during the operation of the suction process of a helium gas by the revolution of both the scrolls 5 and 6, a suction working chamber 8*c* is formed in the outer side of orbiting scrolls by an outer curve 661 of the orbiting scroll 6 and an inner curve 561 of the fixed scroll 5.

On the other hand, a suction working chamber 8*d* is formed in the radially inner side by an inner curve 662 of the orbiting scroll 6 and an outer curve 562 of the fixed scroll 5. A bearing 40 (roller bearing) is formed in the middle portion of the frame 7. A rotating shaft 14 is supported by the bearing 40. An eccentric shaft 14*a* provided at the end of the rotating shaft 14 is rotatably inserted into the boss 6*c*.

The fixed scroll 5 is fixed to the frame 7 by a plurality of bolts. The orbiting scroll 6 is supported in the frame 7 by an Oldham mechanism 38 configured with an Oldham ring and an Oldham key. The orbiting scroll 6 is formed to revolve relative to the fixed scroll 5 without rotating on the axis of the orbiting scroll 6. The rotating shaft 14 is integrally connected to the motor shaft 14*b* and connected to the motor part 3.

The motor part 3 is connected to an inverter 400 via an internal lead wire 3*m*, a hermetic connector 72, and a connector block 70. The inverter 400 may be an inverter of an AC-type or a DC-type. Generally, DC-type inverter has an advantage in efficiency by a few percent. 500 is a commercial power supply. 450 and 390 are three-phase power cables.

The suction tube 17 penetrates the upper cover 2*a* of the sealed container 1 and is connected to the suction port 15 of the fixed scroll 5. The discharge chamber 1*a* to which a discharge port 10 is opened is linked with the motor chamber 1*b* (1*b*1, 1*b*2) via first passages 18*a* and 18*b* located in the periphery of the frame 7. The motor chamber 1*b* is linked with a discharge tube 20 which penetrates a casing 2*b* in the middle of the sealed container 1.

The discharge tube 20 is provided in the location almost opposite to the location of the passages 18*a* and 18*b*. The motor chamber 1*b* is parted into a chamber portion 1*b*1 which is located above a stator 3*a* and a chamber portion 1*b*2 which is located below the stator 3*a*.

A passage 25 (25*b*, 25*c*) through which the oil and the gas flows is formed between the stator 3*a* and the inner surface 1*m* of the casing 1*d* so as to link together the chamber portions 1*b*1 and 1*b*2 which stays apart on the both sides of the stator 3*a*. A gap 26 of an air gap of the motor part 3 also functions as a passage which links the chamber portion 1*b*1 with the chamber portion 1*b*2 via the gap 26. In such motor chamber portions 1*b*1 and 1*b*2 inside the container, the motor can directly be cooled by the mixed flow of a gas and an injection oil for cooing with relatively low temperature of 60 to 70 degrees.

An O-ring 53 which seals the high pressure portion and the low pressure portion is provided between the suction tube 17 and the fixed scroll 5. Further, a room 36 (hereinafter referred to as a back pressure chamber) surrounded by the scroll compression mechanism part 2 and the frame 7 is formed in the back of the end plate of the orbiting scroll 6.

To the back pressure chamber 36, an intermediate pressure Pb of the suction pressure Ps and the discharge pressure Pd is introduced via two thin holes 6*d* and 6*f* drilled in the end plate of the orbiting scroll 6, and 6*h*. The intermediate pressure Pb provides an axial force which pushes the orbiting scroll 6 toward the fixed scroll 5.

A lubricating oil 23 is accumulated in the bottom of the sealed container 1 and supplied to the orbiting bearing 32 via an oil-sucking tube 27 and a center hole 13 provided in the rotating shafts 14*a* and 14*b*. The oil supplied to the orbiting bearing 32 is then discharged and transferred to the back pressure chamber 36.

On the other hand, oil is supplied to a lower bearing 39 from the center hole 13 through a side hole 51 by a centrifugal pumping action. The oil discharged from the lower bearing 39 reaches the main bearing 40, which is a roller bearing, in the upper portion and is transferred to the back pressure chamber 36. The oil thus transferred to the back pressure chamber 36 is discharged to the compression chambers 8*a* and 8*b* via the holes 6*d* and 6*f*, and the side hole 6*h*, and mixed with an compressed gas, and then discharged to the discharge chamber 1*a* together with helium gas.

An oil extraction tube 30 is provided in the bottom of the sealed container 1, in order to extract the lubricating oil 23 to the outside of the container from the bottom. The lubricating oil 23 accumulated in the bottom of the sealed container 1 flows into the oil extraction tube 30 from the flow inlet 30*a* of the oil extraction tube 30 by the differential pressure between the discharge pressure Pd inside the sealed container 1 and the pressure Pi inside the compression chamber 8, specifically, by the pressure (Pi) at the opening of the oil injection hole 22.

The oil flowed into the oil extraction tube 30 passes through an external oil tube 36*a* to reach an oil cooler 33. The oil is suitably cooled in the oil cooler 33 and then injected to the suction working chamber 8*c* and the compression chamber 8 (8*a*, 8*b*) through an oil tube 36*b*, an oil injection tube 31, and the oil injection port 22.

The oil is injected into the suction working chamber 8*c* and the compression chambers 8*a* and 8*b* by the differential pressure. By employing an oil injection structure according to the embodiment described below, in which the opening of the oil injection port 22 is close to the suction pressure side, the differential pressure for oil supply can be larger than that of a conventional apparatus, and thus a larger amount of injection oil can be attained.

As illustrated in FIG. 2, the fixed scroll 5 is constituted with a disk-shaped end plate 5*a* (plate of fixed side) and a wrap 5*b* formed in an involute curve, or a curve approximate to the involute curve, which is vertically provided on the end plate 5*a*. The discharge port 10 is provided in the middle portion of the fixed scroll 5, and the suction port 15 (15*a*, 15*b*) is provided in the periphery of the fixed scroll 5.

Ok is a center point of the coordinate and Xk and Yk are coordinate axes. Each of the point 53 and the point 54 represents a point of contact at the radially outermost portion which forms the compression chamber.

As illustrated in FIG. 5, a orbiting outer compression chamber (outer curve chamber) 8*a* is formed by the orbiting scroll wrap outer curve 661 and the fixed scroll wrap inner curve 561. The orbiting inner compression chamber (inner curve chamber) 8*b* is formed by the inner curve 662 of the orbiting scroll wrap and the fixed scroll wrap outer curve 562.

The distance between the teeth (dimension of Dt in FIG. 2) is calculated by the following equation.

$$Dt=2\times\epsilon th+t$$

where,

ϵth: revolution radius t: wrap thickness

As illustrated in FIG. 1 and FIG. 3, in order to cool the helium working gas, the oil injection tube 31 is provided to penetrate the sealed container 1, and the single oil injection port 22 (22*a*) is provided on a bottom surface between the teeth 5*z* of the end plate 5*a* of the fixed scroll 5.

Such cooling oil injection structure is employed to cool the main body of the compressor and to reduce the temperature of the gas heated by the heat produced during the adiabatic compression of the helium gas. The injection port 22*a* is a circular hole in which the oil injection tube 31 is inserted.

As illustrated in FIG. 7, the suction chamber 5*f* at the terminal end portions of both the scroll wraps is linked with the oil injection port 22, under a certain range of revolution angle, via the suction working chamber 8*c* formed in the radially outer side by the orbiting scroll outer curve 661 and the fixed scroll inner curve 561. The angle is preferable be about 180 degrees (the value of θ5 in FIG. 8).

On the other hand, as illustrated in FIG. 6, the opening of the oil injection port 22 is provided on the bottom surface between the teeth 5*z* of the fixed scroll 5 so that the suction working chamber 8*d* formed, in the radially inner side, by the orbiting scroll inner curve 662 and the fixed scroll outer curve 562 and the suction chamber 5*f* are positioned not to be linked, without fail, with the oil injection port 22.

The suction working chamber 8*c* in the radially outer side and the suction working chamber 8*d* in the radially inner side are the working chambers during the suction process, which are related to the suction volume.

As illustrated in FIG. 2, the location of the oil injection port 22 is determined to be in a position which is Δθs (about 2π/3) rad, by a scroll wrap winding angle, inside in the circumferential direction from the point 54 which is the radially outermost portion of the fixed scroll wrap inner curve 561.

Further, as illustrated in FIG. 3, the hole diameter Do of the circular shaped opening of the oil injection port 22 is determined to be larger than the wrap thickness t of the orbiting scroll 6. That is, Do>t. The wrap thicknesses t of the fixed scroll 5 and the orbiting scroll 6 are determined to be the same value.

By determining the positional relationship as described above, the cooling of the helium gas is facilitated by the oil injection at an early timing (period) in the suction process of helium gas, whereby the effect of improving volumetric efficiency of the compressor can be obtained.

In FIG. 6 and FIG. 7, the flow of helium gas around the suction chamber 5*f* is illustrated in an arrow. As illustrated in both FIG. 6 and FIG. 7, the suction passage to reach the suction working chamber 8*c* which is in the radially outer side is as follows. The gas flows from the suction hole 15*b* to the suction chamber 5*f* in the counterclockwise direction, flows into the outer side of the orbiting scroll wrap from the orbiting scroll wrap spiral end portion 6*k*, and then flow through the concavity 5*m* to reach the fixed scroll wrap spiral end portion 54.

On the other hand, the suction passage distance to the suction working chamber 8*d* which is in the radially inner side, that is, the passage toward the compression chamber 8*b*, is the distance of the passage in which the gas flows from the suction hole 15*b* to the suction chamber 5*f* in the counter-clockwise direction and reaches the orbiting scroll wrap spiral end portion 6*k*.

Therefore, the distance of the suction passage to reach the suction working chamber 8*c* in the radially outer side is longer than the distance of the suction passage to reach the suction working chamber 8*d* in the radially inner side by about a half of the whole perimeter including the concavity 5*m*, which produces greater effect of heat transfer from the wall surface.

However, when the structure described above is employed, cooling is facilitated by early oil injection so that the effect of heat loss produced by the passage wall which is related to the length of the passage can be eliminated.

In FIG. 4, Os is a center point of the coordinate and Xs and Ys are coordinate axes. The set volume ratio Vrs determined by the orbiting outer compression chamber 8*a* formed by the orbiting scroll wrap outer curve 661 and the fixed scroll wrap inner curve 561 is expressed by the following equation.

$$Vrs = \frac{2\lambda ls - 4\pi + \alpha}{2\lambda ss + 2\pi + \alpha} \tag{2}$$

where,

- λls: Wrap winding end angle at the point 65 (involute development angle)
- λSs: Wrap winding start angle at the point 61 (involute development angle)
- π: the ratio of the circumference of a circle to its diameter
- α: ratio (=ϵth/α) of orbiting radius ϵth to base circle radius a of the scroll wrap The set volume ratio Vrs is calculated by dividing a stroke volume Vths which is a maximum suction volume of the orbiting outer compression chamber 8*a*, by a volume Vd1 which is the volume of the innermost chamber, in the orbiting outer compression chamber 8*a* side, just before the start of the discharge process of the compression chamber.

On the other hand, a set volume ratio Vrk which is determined by the orbiting inner compression chamber 8*b* formed by the orbiting scroll wrap inner curve 662 and the fixed scroll wrap outer curve 562 is calculated in a similar manner to the Vrs.

The point 64 and the point 65 at the wrap spiral end portion 6*k* of the orbiting scroll 6 are smoothly connected with an arc having a radius of R4.

At the wrap start portion, the point 61 and the point 60 are smoothly connected with a convex arc having a radius of Rs, and the point 61 and the point 65 is smoothly connected with concave arc having a radius of R3. An intermediate pressure hole 6*d* links the compression chambers 8*a* and 8*b* with the back pressure chamber 36. A hole 6*f* and a side hole 6*h* are side hole passages which link the compression chamber 8*b* with the side chamber 6*m* (see FIG. 1).

In the embodiment, the set volume ratios are determined as: Vr=Vrk=Vrs=1.7. The value is determination as above, according to the operation condition unique to helium. For a compressor for helium, an operation condition under a range of small pressure ratio, for example, a pressure ratio Pd/Ps of around 1.5 to 1.7, is required in recent years.

When expressed in relation with the operation pressure condition, it is important that the ratio (Ps/Vr), that is, a ratio of the suction pressure Ps (unit: MPaG) of the compressor to the set volume ratio Vr of the compression chamber formed by the fixed scroll side and the orbiting scroll side is within a range from 0.7 MPaG to 1.2 MPaG. That is, two factors, which are the suction pressure Ps and the set volume ratio Vr, have a great impact on the effect of energy saving.

There is an optimum range for the value of the Ps/Vr. As an example of the optimum value, Ps/Vr is 1.0 under the condition of Vr=1.7 and Ps=1.7 MPaG. As for the related art, the value of Ps/Vr is in the range from 0.3 MPaG to 0.6 MPaG, and further effect of energy saving is desired.

FIG. 5 illustrates a state in which a fixed scroll 5 and a orbiting scroll 6 are engaged with each other after each suction process of an outer curve chamber 8*a* and an inner curve chamber 8*b* is completed. In this state, the point 53 and the point 64 make contact with each other, and also the point 54 and the orbiting scroll side outer curve 661 make contact with each other. In this state, the opening of the injection port 22 is linked only with the outer curve chamber 8*a* side.

FIG. 6 is an example in which the fixed scroll 5 and the orbiting scroll 6 are engaged with each other after advancing the revolution angle for about a half the π from the state in FIG. 5. In this state, the opening of the injection port 22 is linked only with the inner curve chamber 8*b* side.

Further, the opening of the injection port 22 is linked with one of the two intermediate holes 6*d* and the side hole passages 6*f* and 6*h*. Since the three holes, which are 22, 6*d* (one of the two), and 6*f*, are arranged in such positional relationship in which every three holes are temporarily linked among each other, a mass amount of oil injected from the injection port 22 can flow out of the compression chamber 8*b* to the back pressure chamber 36 side, which prevents the compression chamber to be filled with oil. Therefore, a function and an effect of preventing the happening of unusual pressure rise due to oil compression are achieved.

FIG. 7 is an example in which the fixed scroll 5 and the orbiting scroll 6 are engaged with each other after further advancing the revolution angle for about half the π from the state in FIG. 6. In this state, by determining the dimensional relation between the hole diameter Do and the wrap thickness t as in a case of the oil injection port 22 being a circular hole, that is, Do>t, the oil injection port 22 is linked with both the orbiting inner compression chamber 8*b* and the orbiting outer suction working chamber 8*c*. The range of angle in which such linked state can be provided is θ4 in FIG. 8.

In FIG. 8, the pressure change Pi/Ps in the compression chambers 8*a* and 8*b* is illustrated with the horizontal axis representing the revolution angle during the orbiting motion. The point A represents the start of the suction process, and the point B represents the end of the suction process as well as the start of the compression. The point C represents the end of the compression. Under the further revolution angle, the discharge process is carried out. The revolution angle of the suction process is θ1=2π.

The range of revolution angle illustrated in θ2 represents the range of angle in which the opening of the injection port 22 is linked with the outer curve chamber 8*a* side.

The range of revolution angle illustrated in θ3 represents the range of angle in which the opening of the injection port 22 is linked with the inner curve chamber 8*b* side. During the revolution angle range of θ3, the positional relationship is such that the orbiting inner curve chamber 8*b* side is not linked, without fail, with the suction chamber 5*f* side via the oil injection port 22.

By employing the oil injection structure of the embodiment as described above, the oil injection into the suction working chamber 8*c* in the radially outer side and into both the compression chambers 8*a* and 8*b* is smoothly carried out even under the condition of low pressure ratio. The injected cooling oil performs a function of cooling the working gas and a function of sealing between the compression chambers in both the compression chambers 8*a* and 8*b*.

Further, lubrication of the sliding portion such as a scroll wrap distal end portion is carried out uniformly and effectively. As a result, for a sealed scroll compressor for helium, a high volumetric efficiency is achieved, and a high compression efficiency is achieved by reducing the internal leakage. Therefore, high reliability can be obtained for an overall compressor.

Figure 9:
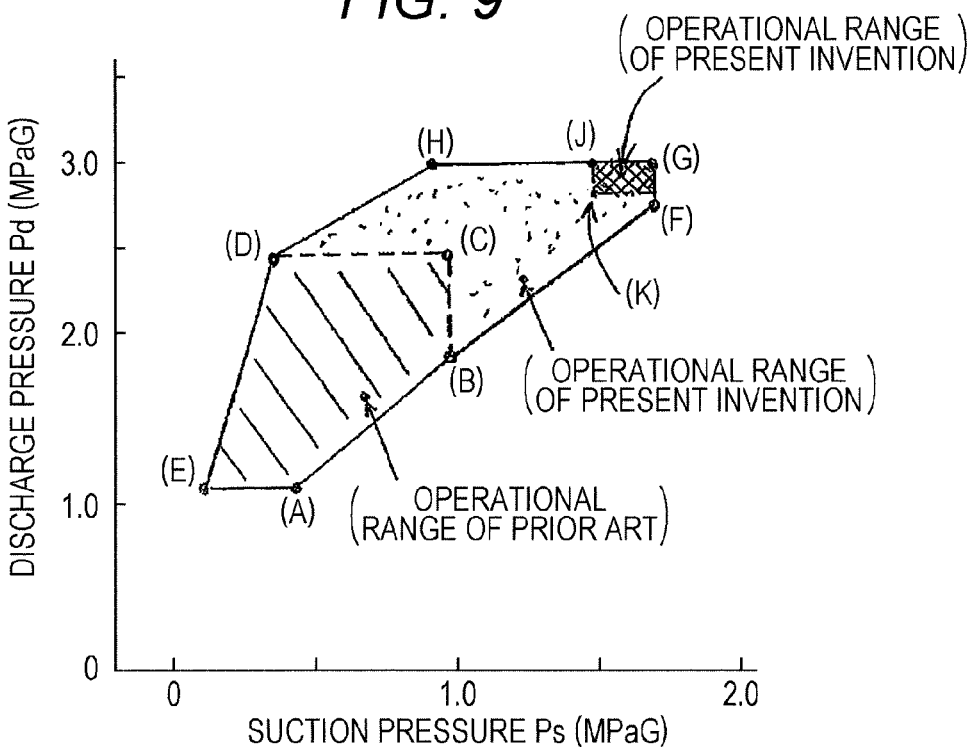
FIG. 9 is an explanatory drawing illustrating an operation pressure range.
Figure 10:
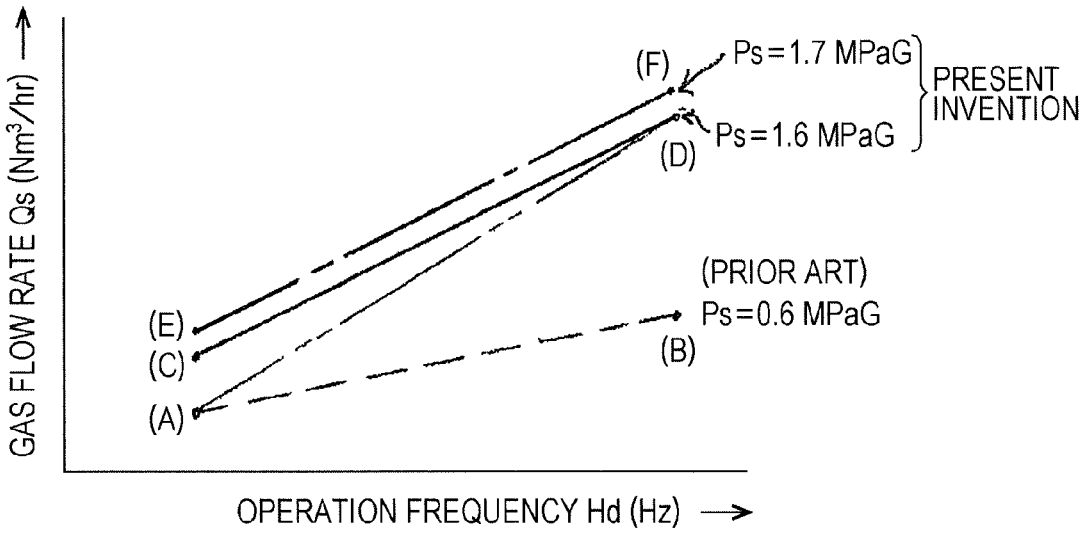
FIG. 10 is an explanatory drawing illustrating a relation between an operation frequency Hd and a gas flow rate Qs.

FIG. 9 is an explanatory drawing illustrating an operation pressure range. FIG. 10 is an explanatory drawing illustrating a relation between an operation frequency Hd and a gas flow rate Qs.

In the embodiment, a driving motor part 3 is driven by an exterior inverter 400.

The conventional operation range is within E-A-B-C-D-E in FIG. 9. In the embodiment, the operation range is determined to be within K-F-G-J-K. Specifically, the suction pressure Ps is determined to be within a range from 1.5 MPaG to 1.8 MPaG, and the discharge pressure Pd is determined to be within a range from 2.8 MPaG to 3.1 MPaG. That is, the operation range shifts to the range with higher suction pressure and higher discharge pressure compared to the conventional operation range. Further, the operation range may be within E-A-B-F-G-J-H-D-E.

As illustrated in FIG. 10, by determining the condition of the operation range as described above, the characteristic of gas flow represented by C⇆D and E⇆F is obtained according to the characteristic of the gas flow of the related art, that is, A⇆B. As a result, the embodiment can provide two to three times greater gas flow of the compressor than the apparatus of the related art. Thus, the compressor can be small-sized.

Further, as for a capacity controlling range of the gas flow rate, for the related art, the degree of [gas flow rate at A]/[gas flow rate at B] is 0.4 and the capacity controlling range corresponds to the change in gas flow rate from 40% to 100%. For the embodiment, the degree of [gas flow rate at A]/[gas flow rate at F] is 0.15 and the capacity controlling range corresponds to the change in gas flow rate from 15% to 100%. This improvement in the capacity control provides a great effect of energy saving. By employing such configuration as described above, a smaller-sized and high performance scroll compressor for helium can be provided.

Figure 11:
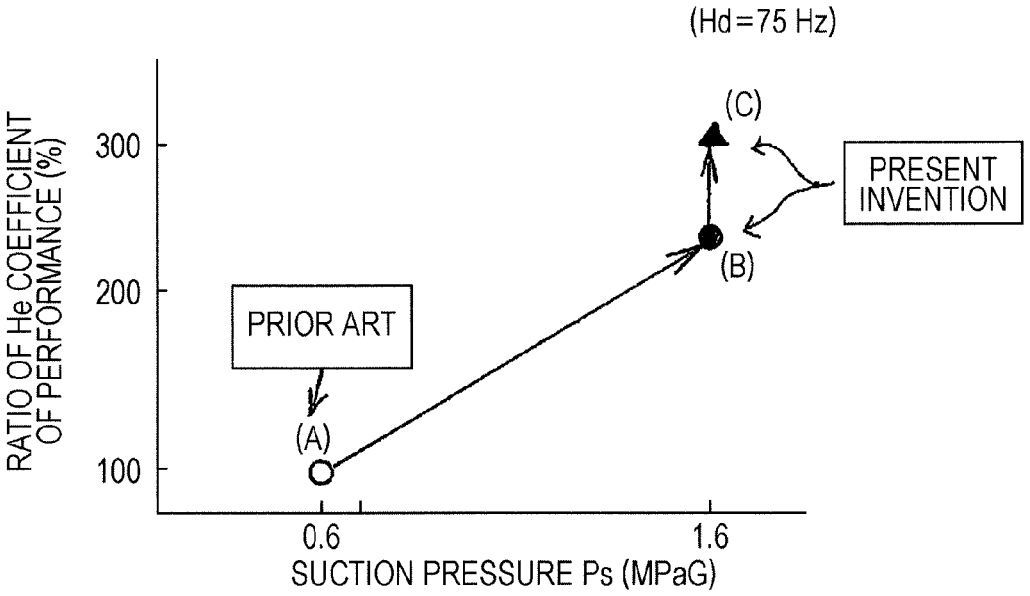
FIG. 11 is an explanatory drawing illustrating a relation between a suction pressure Ps and a coefficient of performance E (ratio).

FIG. 11 is an explanatory drawing illustrating a relation between the suction pressure Ps and the coefficient of performance for helium E ratio.

The He coefficient of performance E is calculated by dividing a gas flow rate Qs (Nm3/hr) by a compressor input Wi (kW) (inverter input, in a case of inverter-driven type). When the value E is large, the effect of energy saving is high.

An example of the effect in a case of the inverter-driven type is illustrated in FIG. 11. As illustrated in FIG. 11, compared to the point A which represents the He coefficient of performance of the related art, the He coefficient of performance of the embodiment is two to three times higher as represented by the point B and the point C. The improvement from the point A to the point B owes to the oil injection structure of the embodiment and the effect produced by providing high suction pressure and discharge pressure. The ratio of the He coefficient of performance ratio is about 2.5.

Further, the improvement from the point B to the point C owes to the effect produced by changing the set volume ratio Vr from 2.1 to around 1.7 for the embodiment. The ratio of the He coefficient of performance ratio is about 1.2. As a result, the effect of the improvement in the He coefficient of performance produced by the embodiment is represented by the difference between the point A and the point C. The ratio of the He coefficient of performance is about three, thereby producing a distinct effect of energy saving.

Similarly, a helium compressor for a constant speed operation, in which the ratio Ps/Vr is determined to be within a range from 0.7 MPaG to 1.2 MPaG, where Ps is the suction pressure and Vr is a set volume ratio of the compression chamber formed by the fixed scroll side and the orbiting scroll side as in the embodiment, gives a high degree of the coefficient of performance E of about two to three times higher than the coefficient of performance E of a conventional apparatus according to experiments.

AS can be seen, the embodiment can be applied to helium compressors for a constant speed operation and inverter-driven type.

What is claimed is:

1. A sealed scroll compressor for helium in which a working gas is a helium gas, comprising:

a scroll compression mechanism part and a motor part that are contained in a sealed container, a compression chamber configured by a fixed scroll in which a scroll-shaped wrap is vertically provided on a fixed side plate and an orbiting scroll engaging the wraps with each other in the scroll compression mechanism part, wherein the orbiting scroll is engaged with an eccentric mechanism connected to a rotating shaft, and revolves relative to the fixed scroll without rotating on an axis of the orbiting scroll, the fixed scroll is provided with a discharge port with an opening to the center portion of the fixed scroll and a suction port with an opening to the outer periphery of the fixed scroll, the helium gas which is suctioned from the suction port is compressed as the helium gas advances in the compression chamber toward the center portion thereof, and then discharged from the discharge port, an oil injection tube for cooling the helium gas is provided so as to penetrate the sealed container and be connected to an oil injection port provided on the fixed side plate, a suction chamber located at terminal end portions of both the scroll wraps communicates with the oil injection port, during a suction process and until the suction process is completed, via a suction working chamber formed in a radially outer side by an orbiting scroll outer curve and a fixed scroll inner curve, and an opening of the oil injection port is provided on a bottom surface between teeth of the fixed scroll so that a suction working chamber formed, in a radially inner side, by an orbiting scroll inner curve and a fixed scroll outer curve and the suction chamber, is not always communicated with the oil injection port during the suction process.

2. The sealed scroll compressor for helium according to claim 1, wherein:

the range of the revolution angle in which the suction chamber links with the oil injection port via the suction working chamber formed, in a radially outer side, by the orbiting scroll outer curve and the fixed scroll inner curve is about 180 degrees; and the opening of the oil injection port is circular-shaped and a hole diameter of the opening is determined to be larger than a thickness of a wrap of the orbiting scroll.

3. The sealed scroll compressor for helium according to claim 2, wherein a center of the opening of the oil injection port is located in a position which is about $2\pi/3$ rad, by a scroll wrap winding angle, inside in a circumferential direction from a wrap spiral end portion of a fixed scroll inner curve, and π is a ratio of a circumference of a circle to its diameter.

4. The sealed scroll compressor for helium according to claim 1, wherein a suction pressure is determined to be in a range from 1.5 MPaG to 1.8 MPaG, and a discharge pressure is determined to be in a range from 2.8 MPaG to 3.1 MPaG.

5. The sealed scroll compressor for helium according to claim 1, wherein a ratio Ps/Vr, which is a ratio of a suction pressure Ps to a set volume ratio Vr of a pressure chamber formed by the fixed scroll and the orbiting scroll, is in a range from 0.7 MPaG to 1.2 MPaG.

* * * * *